United States Patent [19]

Doerre

[11] 4,103,295

[45] Jul. 25, 1978

[54] APPARATUS FOR SIGNALING AN UNAUTHORIZED REMOVAL OF A GARMENT FROM A PREMISES

[75] Inventor: Reinhard Doerre, Oberboihingen, Fed. Rep. of Germany

[73] Assignee: Firma E. Breuninger KG., Stuttgart, Fed. Rep. of Germany

[21] Appl. No.: 746,838

[22] Filed: Dec. 2, 1976

[30] Foreign Application Priority Data

Dec. 2, 1975 [DE] Fed. Rep. of Germany ..... 2554051

[51] Int. Cl.[2] ..... G08B 13/14

[52] U.S. Cl. ..... 340/572

[58] Field of Search ..... 340/248 R, 248 B, 253 B, 340/253 C, 280, 258 R, 258 C, 258 D

[56] References Cited

U.S. PATENT DOCUMENTS

| | | | |
|---|---|---|---|
| 3,493,955 | 2/1970 | Minasy | 340/258 |
| 3,718,922 | 2/1973 | Williams et al. | 340/280 |
| 3,974,581 | 8/1976 | Martens et al. | 340/280 X |

*Primary Examiner*—Alvin H. Waring

[57] ABSTRACT

A signal-emitting arrangement adapted for non-destructive attachment to a valuable garment, such as a fur coat, is described. A pair of large-area plates are hinged together along corresponding longitudinal edges thereof, one of the plates bearing a signal transmitter. A plurality of corresponding projections and recesses are arranged along the other longitudinal edges of the respective plates so that when such plates are pivoted toward each other with the edge of the garment therebetween, the projections pierce the garment and enter the recesses. The projections and recesses are distributed over the longitudinal edge in staggered fashion to avoid undue force concentration on, and distortion and buckling of, the garment edge. A pair of separate camming projections disposed on one of the plates outside the garment-piercing area of the other projections is releasably lockable in separate aligned recesses on the other plate. For this purpose, suitable blocking members are resiliently biased into such recesses in the path of movement of the camming projections, which have sawtooth-like formations thereon for initially displacing and then releasing the blocking elements to lock the camming projection in the associated recesses when the first set of garment-piercing projections penetrate their recesses.

6 Claims, 6 Drawing Figures

APPARATUS FOR SIGNALING AN UNAUTHORIZED REMOVAL OF A GARMENT FROM A PREMISES

BACKGROUND OF THE INVENTION

The invention relates to devices attachable to consumer goods for indicating the unauthorized removal of such goods from a prescribed area, and more particularly to devices of this general nature suitable for attachment to a fragile or expensive garment.

In U.S. Pat. No. 3,718,922 issued to A. L. Williams et al. on Feb. 27, 1973, a theft-indication device suitable for association with certain types of consumer goods is described. In particular, a pair of levers having confronting bent ends are supported for mutual oscillation, with the outer surfaces of the bent ends of the respective levers individually exhibiting mating projections and recesses which are joined together through the article to be protected. One of the two levers has a suitable signal transmitter therein, so that when the article with the levers attached thereto moves past a sensing area on the premises, a suitable detector at the sensing area picks up the indication emitted by the generator to trigger a suitable alarm.

Unfortunately, the use of such bent levers, which are heavy and bulky in construction, are unsuitable for attachment to fine clothing, since the mass of the levers and the concentration of the needle-like projections in the piercing area of the garment would tend to buckle, distort and otherwise damage the garment.

SUMMARY OF THE INVENTION

Such disadvantages are overcome with the protective device of the present invention, which is adapted for releasable attachment to a fine fur or other garment in a safe and effective fashion. In an illustrative embodiment, the protective device includes a pair of elongated plates which are hinged together along a first longitudinal edge thereof for movement between a first position, in which confronting first surfaces of the respective plates serve to clamp an edge of the garment therebetween, and a second position in which the plates are pivoted away from each other to release the garment. A plurality of needle-like, garment-piercing projections, which are distributed in an elongated array along a second longitudinal edge of one of the plates in staggered fashion, are adapted to pierce the garment edge in a harmless fashion and to be received in a corresponding wide-area distribution of recesses in the confronting surface of the other plate when the plates are pivoted into their garment-receiving position.

The plate bearing the garment-piercing projections is provided, outside the garment-piercing area, with an additional cam-like second projection on its face confronting the other plate, such second projection having a sawtooth-like formation for engaging and displacing a spring-loaded blocking element which selectively projects into a correspondingly aligned second recess on the opposite plate. Once the sawtooth formation of the projection has entered the corresponding recess, the blocking plate is released to lock the projection inside the recess until the blocking element is again displaced against the force of its biasing spring by a suitable actuating member; illustratively, the biasing element may be formed from ferromagnetic material, in which case the actuating element may be a permanent magnet.

To provide an additional degree of resistance against removal of the hinged plate assembly from the garment edge, each camming projection may be provided with a pair of radially symmetric sawtooth formations, with the respective formations adapted to oppositely displace separate spring-biased blocking elements in the associated recesses. In such case, in order to remove the projections from the recesses after both formations are locked therein, the respective blocking elements have to be separately moved into an inoperative position by suitable actuating means, which may be dissimilar in nature to minimize the possibility of tampering.

Preferably, the two blocking elements may be formed from longitudinally staggered, transversely overlapping U-shaped pieces, with a common biasing spring extending between the confronting inner legs of the resulting arrangement. By suitable selection of the distance between the legs of the respective U-shaped pieces, symmetry of operation of the blocking members by the sawtooth formations on the associated camming projections can be guaranteed.

The respective plates can easily be formed of a lightweight plastic material, which together with the wide-area, staggered distribution of the garment-piercing projections on one of the plates effectively precludes any damage to the fragile garment associated therewith. In addition, the above-mentioned releasable locking means of the second set of projections and recesses on the mating surfaces of the plates assures a simple, effective and tamper-proof engagement of the garment with the protective device.

BRIEF DESCRIPTION OF THE DRAWING

The invention is further set forth in the following detailed description taken in conjunction with the appended drawing, in which.

DETAILED DESCRIPTION

Figure 1:
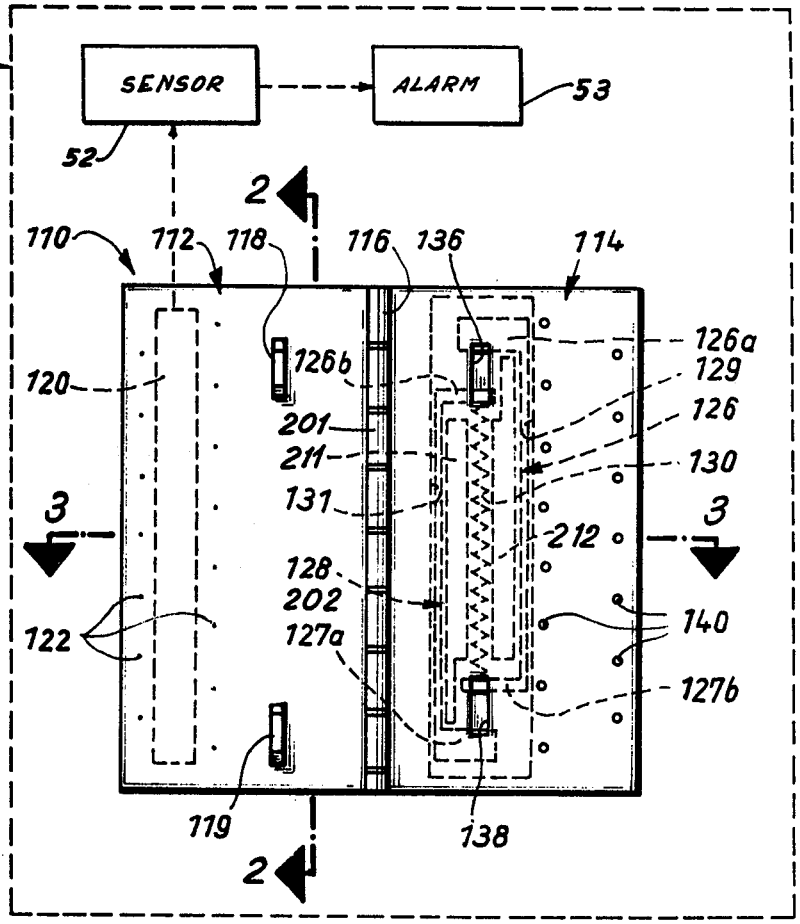
FIG. 1 is a front view of a protective device constructed in accordance with the invention for releasable attachment to the edge of a fine garment, the device being shown in its unoperated position.

Referring now to the drawing, FIG. 1 depicts in highly stylized form a security area 51 having a suitable sensing element 52 disposed therein, as at an exit location thereof, for receiving an indication emitted from a conventional signal generator 120, which is permanently housed in a protective device 110, described in detail below. The sensor 52 responds to an indication from the generator 120 to trigger a suitable alarm device 53, which may be located in the security area 51 or elsewhere.

The protective device 110 is adapted for releasable engagement with a portion 54 (FIG. 3) of a garment, illustratively a fur coat, whose unauthorized removal from the security area 51 when the protective device 110 is attached thereto will cause the signal generator 120 to emit the above-mentioned indication when the device 110, and thereby the garment, is moved past the sensor 52.

In accordance with the invention, the protective device 110 includes a pair of elongated, lightweight plates 112, 114, which are pivoted together along corresponding first longitudinal edges 201, 202 thereof by means of a hinge assembly 116. The so-hinged plates 112, 114 are thereby adapted for pivotal movement about the hinge assembly 116 between an open position depicted in solid lines in FIGS. 1–3 and a closed position schematically indicated in FIG. 3, wherein confronting surfaces 203, 204 of the plates 112, 114 engage opposed surfaces of the garment portion 54 adjacent second longitudinal edges 206, 207 thereof.

A plurality of recesses 140 are distributed in a regular array in the surface 204 of the plate 114 substantially entirely along the plate in the region of the outer longitudinal edge 207. In the particular arrangement depicted in FIG. 1, the recesses 140 are arranged in a pair of transversely spaced, longitudinally staggered rows.

Figure 3:
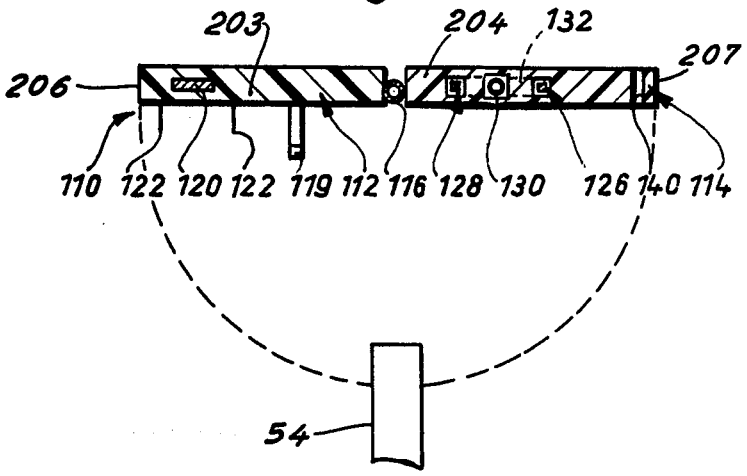
FIG. 3 is a sectional view taken along line 3—3 of FIG. 1.

A corresponding plurality of needle-like, garment-piercing projections 122 extend from the surface 203 of the opposite plate 112 in a regular array corresponding to and aligned with the recesses 140 when the plates 112, 114 are pivoted into their garment-engaging position shown in FIG. 3. In such position, the projections 122 penetrate the portion 54 of the garment and enter the associated recesses 140, so that the device 110 is securely clamped to the garment.

Because of the lightweight nature of the plates 112, 114 and the extended, longitudinally spaced and staggered distribution of the projections 122 and the corresponding recesses 140, such clamping of the garment by the protective device 110 will assure that no undue concentrated stresses, distortions or buckling will be imparted to the garment by the device, so that such device is suitable for attachment to virtually any type of garment.

The signal transmitter 120, which may be of any suitable form known to those skilled in the art, is embedded within the plate 112 by conventional techniques.

In further accordance with the invention, a simple and efficient, virtually tamper-proof releasable locking arrangement is further associated with the device 110 for preventing the unauthorized disengagement of the device from the garment potion 54 once the plates 112, 114 thereof are pivoted into their garment-engaging position with the projections 122 extending into the associated recesses 140.

Figure 2:
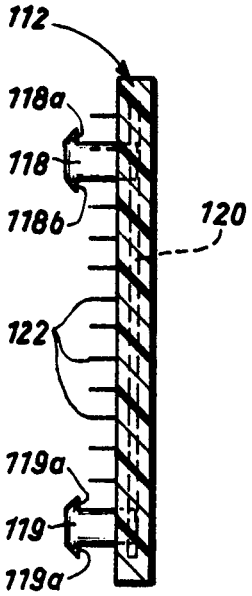
FIG. 2 is a sectional view taken along line 2—2 of FIG. 1.

In the embodiment shown in FIGS. 1–3, such releasable locking arrangement includes a pair of auxiliary recesses 136, 138 disposed in the surface 204 of the plate 114, such recesses being longitudinally spaced and aligned parallel to the edges 202, 207 of the plate 114. In addition, the aligned recesses 136, 138 are transversely spaced from the array of recesses 140 in a direction toward the inner longitudinal edge 202.

A pair of locking projections 118, 119 each extend from the surface 203 of the other plate 112 in aligned relation with the recesses 136, 138, respectively, of the plate 114 when the plates are brought into their garment-engaging position shown in FIG. 3. In such position, the outer ends of the projections 118, 119 are receivable within the recesses 136, 138.

A contoured, elongated recess 132 extends longitudinally through the plate 114 in alignment with and intersecting relation to each of the aligned recesses 136, 138. The recess 132 may be subdivided, by means of partition members 211, 212 into chambers 131, 129. In the chamber 131, an elongated blocking member 128 of generally U-shape is supported for longitudinal movement, with outer legs 126*b*, 127*a* thereof being spaced apart by a distance approximately corresponding to the distance between corresponding points of the recesses 136, 138.

The legs 126*b*, 127*a* extend across the associated recesses 136, 138 when in the locking position.

In like manner, a second generally U-shaped blocking element 126 is supported for longitudinal movement in the chamber 129. Respective outer legs 126*a*, 127*b* of the element 126 are spaced apart, like the legs of the other blocking element 128, by a distance corresponding to that between corresponding points of the recesses 136, 138 in the position shown.

As indicated in FIG. 1, the blocking elements 128, 126 are longitudinally displaced so that the upper leg 126*b* of the element 128 is disposed intermediate the upper and lower legs 126*a*, 127*b* of the element 126. In addition, the longitudinal spacing between the staggered plates 128, 126 is chosen such that the respective upper legs 126*b*, 126*a* thereof may symmetrically extend into the recess 136 from opposite directions when the associated elements are biased into a locking position as discussed below. In like manner, the lower legs 127*a*, 127*b* of the elements 128, 126 will extend, in such locking position, into the lower recess 138 from longitudinally opposite sides thereof.

A compression spring 130 extends between the upper leg 126*b* of the element 128 and the lower leg 127*b* of the element 126 to simultaneously bias such legs in an outward direction and into blocking position within the opposed recesses 136, 138 in the manner depicted in FIG. 1. Such biasing action will simultaneously urge the upper leg 126*a* of the element 126 and the lower leg 127*a* of the element 128 inwardly into blocking relation at the other ends of the recesses 136, 138.

In order to releasably lock the projections 118, 119 in the so-lockable recesses 136, 138, the projection 118 is provided on its outer end with a pair of radially symmetric sawtooth-like formations 118*a*, 118*b*. In like manner, the projection 119 is provided at its outer end with a pair of symmetric sawtooth-shape formations 119*a*, 119*b*.

With this arrangement, when the plates 112, 114 are pivoted into the garment-engaging position shown in FIG. 3, the formations 118*a*, 118*b* will come into contact with the respective legs 126*a*, 126*b* of the elements 128, 126*b*, which legs are disposed in the path of movement of the projection 118. Because the legs 126*a*, 126*b* are resiliently biased by the spring 130 into the illustrated locking position, the pressure of the formations 118*a*, 118*b* on such legs will serve to cam the legs outwardly against the restoring force of the spring 130 until the radial edges at the rear of the formations 118*a*, 118*b* clear the associated legs 126*a*, 126*b*. At this point, the legs will be released, and such legs will be urged by the spring 130 back into their normal blocking position behind such radial edge, thereby locking the projection 118 securely in the recess 136.

It will be appreciated that a corresponding locking of the projection 119 in the recess 138 will occur simultaneously with, and in a manner identical to, the locking of the projection 118 in the recess 136.

Once the projections 118, 119 are so locked, the protective device 110 cannot be removed from the engaged garment without a separate actuating member (not shown), which is adapted to force the blocking elements 128, 126 into its release position against the force of the spring 130. In the arrangement shown in FIG. 1, the elements 128, 126 must be separately moved into such release position, and an actuating member effective to position one of them can be designed separate from that necessary to release the other of them. Therefore, even if a thief could gain access to the actuating member for one of the blocking elements, it would leave unaffected the blocking function of the other element, which will remain in the illustrated position to prevent exit of the associated one of the projections 118, 119.

The actuating member can, of course, take any of several suitable forms. For example, if the blocking elements 128, 126 are formed from ferromagnetic material, the actuating members may take the form of suitable permanent magnets.

Figure 5:
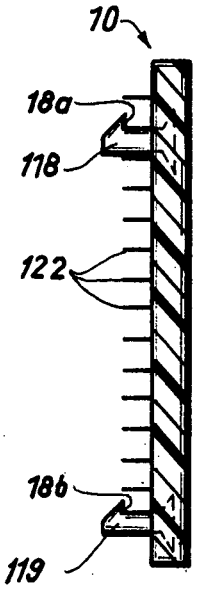
FIG. 5 is a sectional view taken along line 5—5 of FIG. 4.
Figure 4:
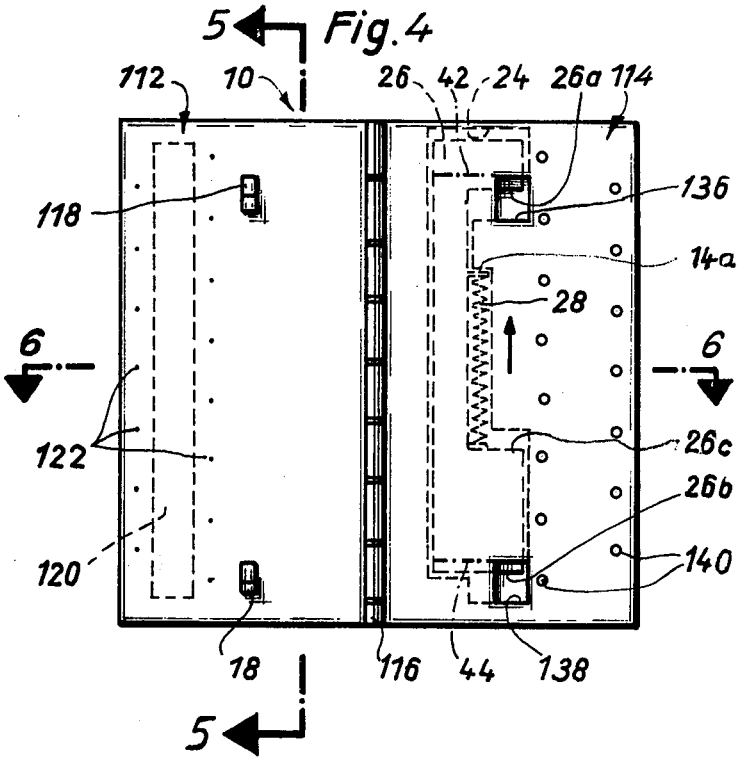
FIG. 4 is a front view, similar to FIG. 1, showing the protective device of the invention with a more simplified releasable securing arrangement for the garment to be protected.
Figure 6:
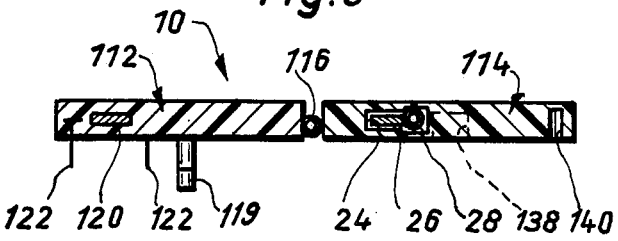
FIG. 6 is a sectional view taken along line 6—6 of FIG. 4.

A simplified arrangement of the protective device of FIGS. 1–3 is depicted in FIGS. 4–6. The modified protective device, designated 10 in FIGS. 4–6, is substantially identical to the device 110 of FIGS. 1–3 except for the releasable locking arrangement for the projections 118, 119.

The recess-bearing plate 114 of the device 10 has an elongated, longitudinally extending recess 24 which, like the recess 132 of FIGS. 1–3, is aligned with and intersects the recesses 136, 138.

In the arrangement of FIGS. 4–6, a single U-shaped blocking element 24 is supported for longitudinal movement within the recess 24, and includes a pair of opposed outer legs **26*a*, 26*b* which are spaced apart by a distance sufficient to provide simultaneous blocking actions on corresponding portions of the respective recesses 136, 138**.

The plate 114 is provided with an abutment section **14*a* extending into the recess 24 intermediate the outer legs 26*a*, 26*b*. One end of a compression spring 28 bears against the abutment 14*a*, while the other end of the spring bears against an inner surface 26*c* of the lower blocking element leg 26*b*. As a result, the blocking element 26 is urged downwardly from a recessed position, illustrated by the dot-dash lines 42, 44, into the position illustrated in FIG. 4, i.e., with the lower edges of the respective legs 26*a*, 26*b*** biased into the associated recesses.

As shown best in FIG. 5, the camming projection 118 is provided at its outer end with a single sawtooth-like formation **18*a*. In like manner, the camming projection 119 is provided with a single sawtooth-like formation 18*b***.

The operation of the releasable locking portion of FIGS. 4–6 is similar to that of FIGS. 1–3. In particular, when the plates 112, 114 are pivoted into the garment-engaging position, the formations **18*a*, 18*b* respectively cam the outer legs 26*a*, 26*b* of the blocking element 26 in an outward direction, i.e., toward the release positions 42, 44. After the formations 18*a*, 18*b* have entered the appropriate recesses, the outward force on the legs 26*a*, 26*b* is released, and such legs are permitted to again move inwardly under the restoring force of the spring 28 to engage and secure the projection 118, 119 behind the radial rear edges of the associated formations 18*a*, 18*b***.

In all other respects, the structure and manner of operation of the embodiments of FIGS. 1–3 and 4–6 are identical.

In the foregoing, some illustrative arrangements of the invention have been described. Many variations and modifications will now occur to those skilled in the art. It is accordingly desired that the scope of the appended claims not be limited to the specific disclosure herein contained.

What is claimed is:

1. In an apparatus for signalling a removal of a garment from an area provided with a sensing element, first and second elongated plates having corresponding first and second longitudinal edges, one of the plates having signal-transmitting means for emitting an indication detectable by the sensing element when the garment is moved past the sensing element with the one plate affixed to the garment, means joining the respective first longitudinal edges of the first and second plates for pivotal movement between a first closed position in which corresponding first surfaces of the plates are disposed in confronting relation for engaging a portion of the garment and a second closed position in which the first surfaces are disengaged from the garment, the first plate having a plurality of first recesses disposed in the first surface thereof and distributed along the second longitudinal edge thereof, the second plate having a correspondingly distributed plurality of first garment-piercing projections extending outwardly from the first surface thereof for penetraing the garment portion and entering the first recesses of the first plate when the plates are pivoted into their first position, the first plate having a pair of longitudinally spaced second recesses disposed on its first surface, the second recesses being situated in transversely spaced relation to the first recesses; and in which the apparatus further comprises, in combination, a pair of second locking projections individually extending from the first surface of the second plate in aligned relation with the second recesses of the second plate when the plates are brought into the first position, the second projections individually extending into the respective second recesses when the first projections extend into the first recesses, and means for releasably locking the second projections in the associated second recesses.

2. Apparatus as defined in claim 1, in which the first plate includes means defining a third recess extending longitudinally therein in alignment with and intersecting relation to the respective second recesses; and in which the releasable locking means comprises, in combination, a substantially U-shaped blocking element having first and second outer legs longitudinally spaced by approximately the longitudinal distance between the second recesses for selectably blocking the second recesses, the blocking element being supported for longitudinal movement in the third recess between a locking position in which the first and second legs thereof individually extend into corresponding regions of the respective second recesses in the paths of movement of the associated second projections on the second plate and a release position in which the first and second legs are withdrawn from the associated second recesses, and spring means supported in the third recess for biasing the blocking element into its locking position.

3. Apparatus as defined in claim 2, in which the releasable locking means further comprises, in combination, a sawtooth-shaped formation on the outer surface of each second projection for successively outwardly camming the associated leg of the blocking element toward its release position against the force of the spring means and then releasing said leg so that such leg is urged back by the spring means to its locking position behind the formation to secure the second projection within the associated second recess.

4. Apparatus as defined in claim 1, in which the first plate comprises means defining a third recess extending longitudinally therein in alignment with and intersecting relation to the respective second recesses; and in which the releasable locking means comprises, in combination, first and second substantially U-shaped blocking elements each having first and second outer legs longitudinally spaced approximately by the longitudinal distance between the second recesses, the first and second blocking elements being supported in transversely spaced relation with their respective legs extending toward each other, the first and second blocking elements being longitudinally staggered whereby the first leg of the first element is disposed between the first and second legs of the second element, each of the first and second elements being supported for longitudinal movement in the third recess between a locking position in which the associated first and second legs individually extend into corresponding regions of the respective second recesses in the paths of movement of the associated second projections on the second plates and a release position in which the first and second legs are withdrawn from the associated second recesses, and spring means for simultaneously urging the first and second blocking elements into their respective locking positions.

5. Apparatus as defined in claim 4, in which the spring means comprises a compression spring extending between the first leg of the first blocking element and the second leg of the second blocking element.

6. Apparatus as defined in claim 4, in which the releasable locking means further comprises a pair of sawtooth-shaped formations extending radially symmetrically from opposite sides of the outer end of each second projection for engaging and successively outwardly camming the corresponding legs of the first and second blocking elements within the associated second recess toward their release position against the force of the spring means and then releasing both such corresponding legs so that such legs are again simultaneously urged back into their locking position behind the associated formations to secure the second projection within the associated second recess.

* * * * *